US006110013A

United States Patent [19]

Minami et al.

[11] Patent Number: 6,110,013

[45] Date of Patent: Aug. 29, 2000

[54] END-FACE POLISHING AND CLEANING APPARATUS

[75] Inventors: Kouji Minami; Hisayuki Hirayama; Muneo Kawasaki; Tomohiro Yoshikawa; Junji Taira; Hiroyuki Tokita, all of Tokyo, Japan

[73] Assignee: Seiko Instruments Inc., Japan

[21] Appl. No.: 09/145,709

[22] Filed: Sep. 2, 1998

[30] Foreign Application Priority Data

Sep. 5, 1997 [JP] Japan ..... 9-241524

[51] Int. Cl.[7] ..... B24B 1/00

[52] U.S. Cl. ..... 451/41; 451/65; 451/278; 451/283; 451/390

[58] Field of Search ..... 451/5, 28, 41, 451/42, 65, 66, 67, 282, 285, 292, 270, 390, 400, 276, 259, 342, 278, 384, 365, 366, 396, 279, 363, 550, 558, 490, 397, 398; 15/4, 21.1

[56] References Cited

U.S. PATENT DOCUMENTS

| | | | |
|---|---|---|---|
| 4,905,415 | 3/1990 | Moulin | 451/279 |
| 5,007,209 | 4/1991 | Saito et al. | 451/41 |
| 5,185,966 | 2/1993 | Mock, Jr. et al. | 451/41 |
| 5,547,418 | 8/1996 | Takahashi | 451/41 |
| 5,557,696 | 9/1996 | Stein | 451/66 |
| 5,643,064 | 7/1997 | Grinderslev et al. | 451/41 |
| 5,813,902 | 9/1998 | Wiegand | 451/65 |

*Primary Examiner*—Derris H. Banks
*Attorney, Agent, or Firm*—Adams & Wilks

[57] ABSTRACT

An end-face polishing and cleaning apparatus comprises at least one jig plate for supporting ferrules each fixed to an end of a respective optical fiber. At least one set of a polishing machine and a cleaning machine is provided for polishing and cleaning the end-faces of the ferrules while the ferrules are supported by the jig plate. A movable mounting device supports the jig plate and moves the jig plate between the polishing machine and the cleaning machine to polish and clean the end-faces of the ferrules. The movable mounting device has a holding member for supporting the jig plate, an elevation shaft for moving the holding member in a vertical direction, and a moving device for moving the holding member in a horizontal direction.

18 Claims, 4 Drawing Sheets

END-FACE POLISHING AND CLEANING APPARATUS

BACKGROUND OF THE INVENTION

This invention relates to an end-face polishing and cleaning apparatus for polishing and cleaning end faces of rod-shaped members such as optical communication fibers.

An optical communication fiber is used after it has been fixed by adhesion to a center hole of a ferrule which is a main member of a connector and then smoothly polished at is end face, together with an end face of the ferrule, to a mirror surface. If the polished surfaces of the ferrule and the fiber thus polished are not vertical to a center axis of the ferrule or the polished surfaces have flaws, the optical connector having ferrules oppositely connected with each other is deteriorated in accuracy at the opposite position, resulting in increase in loss. Consequently, the polished surface of a ferrule including an optical fiber requires finishing of the polished surface with high accuracy.

As a conventional optical fiber end-face polishing apparatus, for example, there is one disclosed in Japanese Patent Unexamined Publication No. H3-26456. The optical fiber end-face polishing apparatus disclosed in this publication has an eccentric plate which rotates on a concentric circle of a rotation disc and has also a planetary gear which transmits rotation of a motor for revolution to this eccentric plate, and these are combined with a polishing plate to cause the polishing plate to rotate and revolve.

Further, the ferrule is polished at the end-face under a state that it is fixed by the jig plate, and polishing powder or polishing solution (hereinafter merely referred to as polishing powder) is adhered to back and side surfaces of the jig plate, ferrule's end-face and the like. In this case, conventionally the ferrule's end-face and the jig plate have been cleaned by turning over the jig plate while fixedly holding the ferrule by the jig plate and being rubbed by an operator with a cleaning brush while supplying the water ejected from a water tap to a predetermined point or by using a cleaning machine.

However, the polishing and cleaning of the ferrule are performed by operator's manual operation using the above polishing machine or cleaning machine, which are respectively independent. Therefore, there are problems of a decline in mass production and an increase in cost. Further, there is another problem that a little variation occurs at every operation when an operator sets, for example, an urging force applied to the ferrule when polishing and so the quality is not stabilized.

It is an object of the present invention to provide, in view of such circumstances, an end-face polishing and cleaning apparatus for automatically polishing and cleaning the end-face of ferrule.

SUMMARY OF THE INVENTION

A first mode of the present embodiment lies in an end-face polishing and cleaning apparatus having at least one set of a polishing machine for polishing end-faces of optical fibers and ferrules under a state that the ferrules fixed to ends of the plural fibers are held by a jig plate and a cleaning machine for cleaning the ferrules polished by the polishing machine, and comprising movably mounting means having a holding means for holding at least one of the jig plate under a nearly horizontal state, elevation means for holding the holding means so as to be vertically movable, and horizontally moving means for supporting the holding means so as to be horizontally movable, wherein the jig plate is automatically, movably mounted between the polishing machine and the cleaning machine, thereby polishing and cleaning the end-faces of the ferrules.

In the first mode, it is possible to automatically polish and clean end-faces of ferrules.

A second mode of the present embodiment lies, in the first mode, in an end-face polishing and cleaning apparatus, wherein the polishing machine and the cleaning machine are provided in plural sets, these are arranged at a predetermined interval, the holding means holds at least one pair of the jig plates, and the elevation means and the horizontally moving means cause the at least one pair of the jig plates to simultaneously move.

In the second mode, polishing and cleaning in plurality of stages can be continuously performed.

A third mode of the present embodiment lies, in the first or second mode, in an end-face polishing and cleaning apparatus, wherein the polishing machine is provided with the jig plates which revolve while rotating under a state that the jig plates are mounted.

In the third mode, the ferrule's end-faces can be worked with high accuracy.

A fourth mode of the present embodiment lies, in any of the first to third modes, in an end-face polishing and cleaning apparatus, wherein the cleaning machine is provided with a cleaning brush which cleans ends of the ferrules and lower surface portion of the jig plate by being rotationally moved under a state that it contacts with the lower surface of the jig plate.

In the fourth mode, the cleaning brush randomly contacts with the lower and side surfaces of the jig plate and ferrule's ends, thereby surely performing the cleaning.

DETAILED DESCRIPTION OF THE PREFERRED EMBODIMENTS

Hereunder, embodiments of the present invention will be explained in detail based on the drawings.

Figure 1:
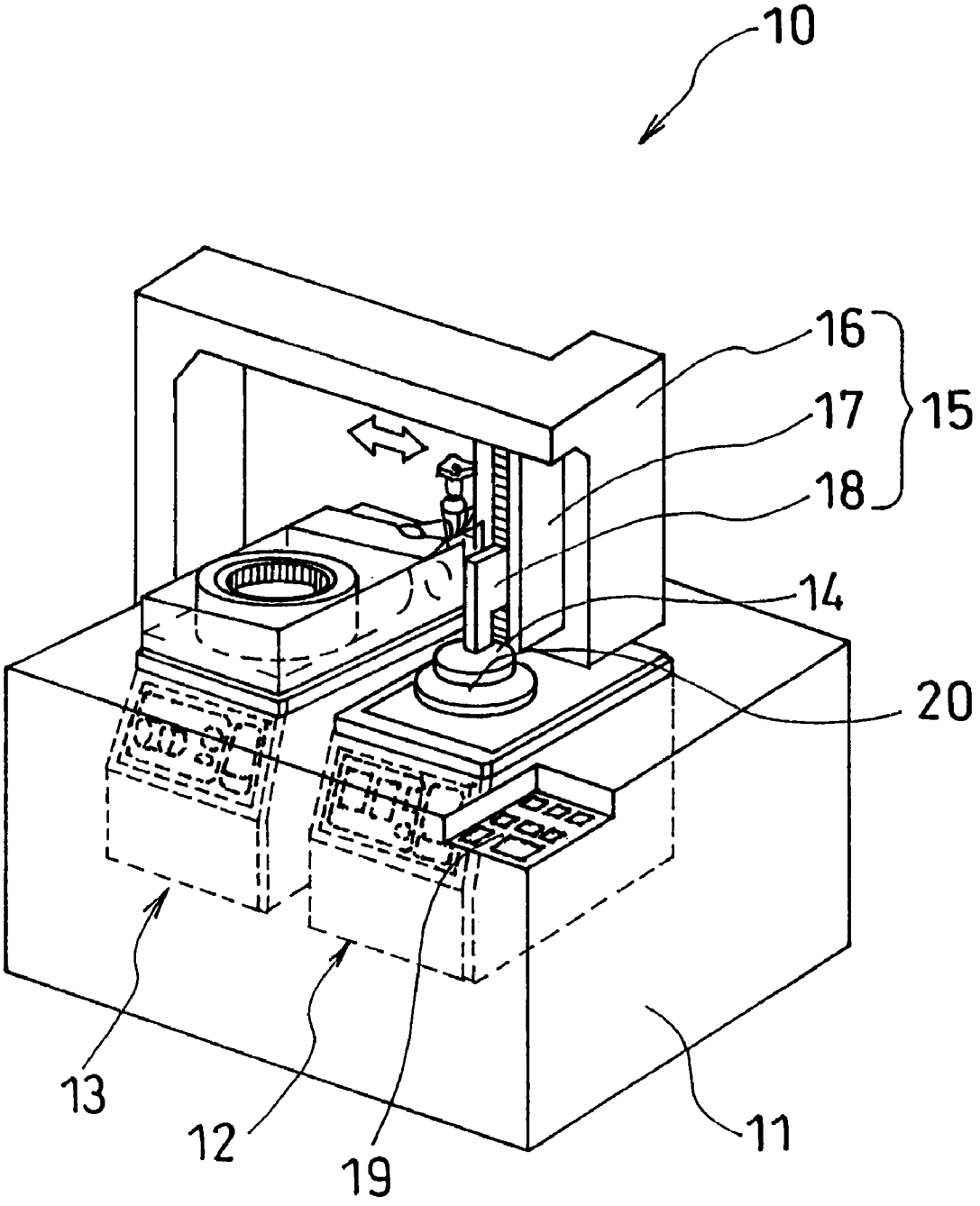
FIG. 1 shows an external appearance view of an end-face polishing and cleaning apparatus according to one embodiment of the present invention.
Figure 2:
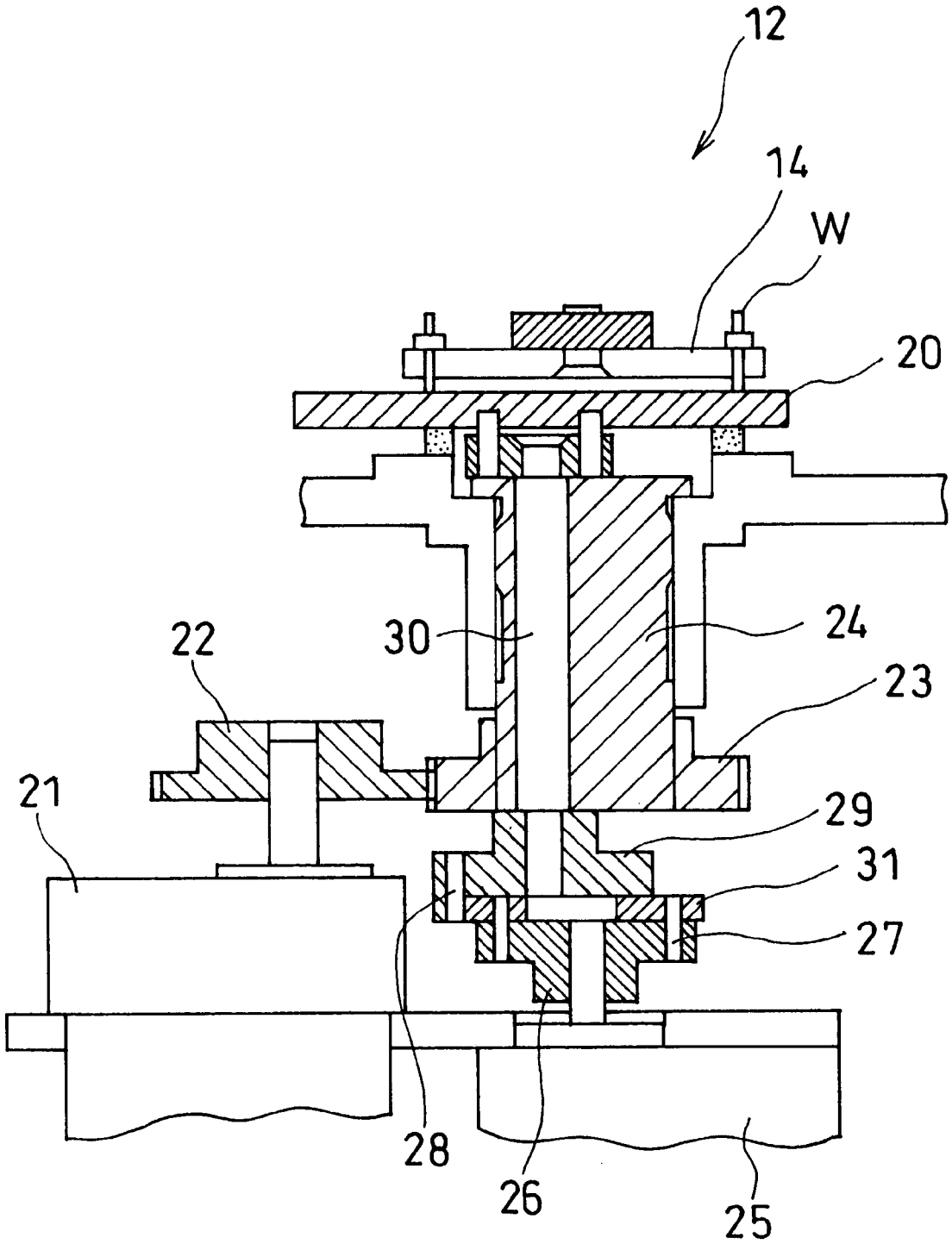
FIG. 2 shows a sectional view of a polishing machine according to one embodiment of the present invention.
Figure 3:
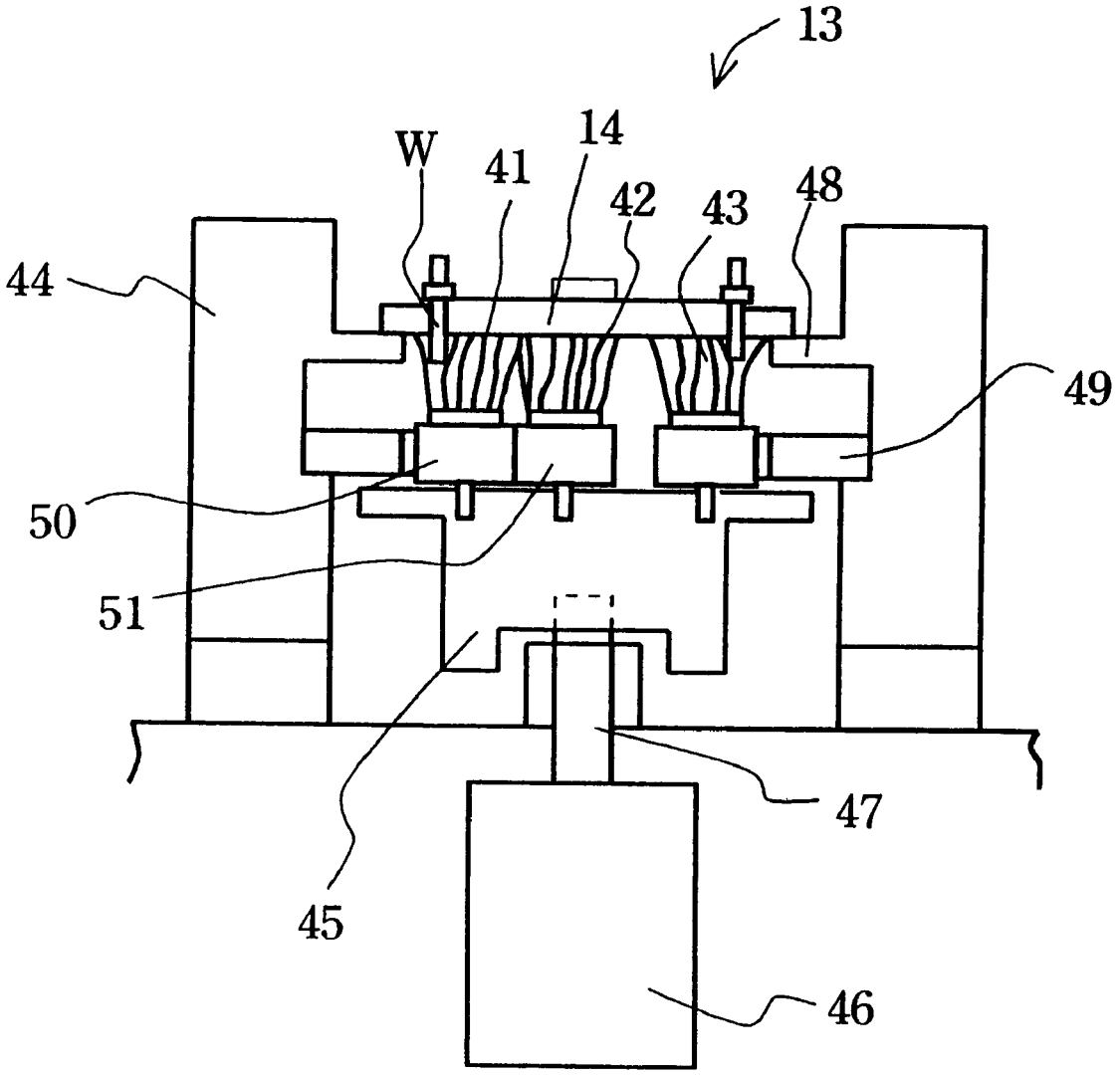
FIG. 3 shows a sectional view of a cleaning machine according to one embodiment of the present invention.
Figure 4:
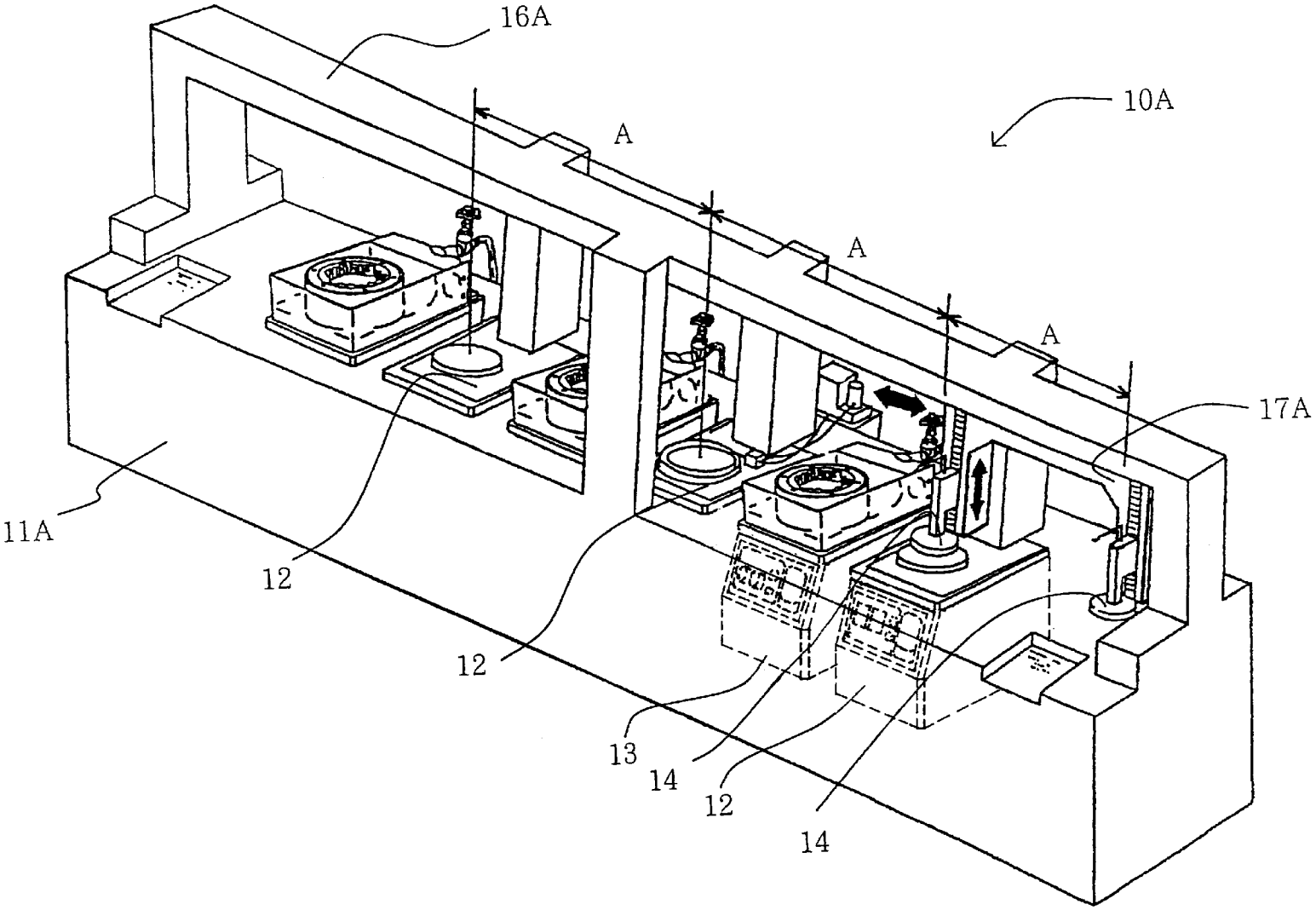
FIG. 4 shows an external appearance view of an end-face polishing and cleaning apparatus according to another embodiment of the present invention.

FIG. 1 shows the front of an end-face polishing and cleaning apparatus according to one embodiment of this invention. FIG. 2 shows the section of a polishing machine according to the present embodiment. FIG. 3 shows the section of a cleaning machine according to the present embodiment. FIG. 4 shows the external appearance of an end-face polishing and cleaning apparatus according to another embodiment.

As shown in FIG. 1, an end-face polishing and cleaning apparatus 10 of the present embodiment is constituted by one set of a polishing machine 12 and a cleaning machine 13 provided within an apparatus main body 11, a jig plate 14 for fixing rod-shaped member such as ferrule, and a movably mounting device 15 for movably mounting the jig plate 14.

This movably mounting device 15 comprises a support arm 16, an elevation shaft 17, and a holding member 18.

The support arm 16 is formed nearly in inverse U-shaped above the polishing machine 12 and the cleaning machine 13 extending therebetween on a lower surface of a horizontal shaft of the support arm 16 there is held the elevation shaft 17 so as to be capable of performing a horizontal straight movement between both machines. The elevation shaft 17 has such a length that it does not contact with a top surface of the main body 11, and at its front surface there is supported the holding member 18 so as to be vertically movable. At a lower end of the holding member 18, the jig plate 14, which is removably fixed at its outer periphery with a plurality of not-shown rod-shaped members, is swingably held under a state that a relative rotation is regulated. Further, the movably mounting device 15 is connected with a driving device such as a not-shown motor or the like, and the elevation shaft 17 and the holding member 18 are moved by the drive of this driving device.

Further, an operating panel 19 for operating the end-face polishing and cleaning device 10 is provided on a top surface of the apparatus main body 11.

The polishing machine 12 polishes the tip end of a ferrule by causing a polishing plate 20 arranged on a polishing machine main body to revolve while causing it to rotate. As shown in FIG. 2, the polishing plate 20 makes a revolving motion by a predetermined eccentric amount by driving a motor 21 for revolution to rotate a revolution transmitting shaft 24 through gears 22, 23.

On the other hand, by driving a motor 25 for rotation, a first rotation transmitting plate 26 is rotated, and a second rotation transmitting plate 29 is rotated through a first coupling pin 27 and a second coupling pin 28, which are arranged on the concentric circle. Due to this, a rotating shaft 30 for rotation is rotated, and the polishing plate 20 rotates at the same number of rotation as the first rotation transmitting plate 26. Incidentally, although the rotating shaft 30 for rotation is eccentric by a predetermined amount, since it is connected through a rotation transmitting plate 31, a rotation of the same number of rotation as the first rotation transmitting plate 26 is transmitted to the rotating shaft 30 for rotation.

In this manner, the end-face of the ferrule is polished by the fact that the polishing plate 20 revolves while rotating by rotary motions of the revolution transmitting shaft 24 and the rotating shaft 30 for rotation.

Further, the cleaning machine 13 causes, as shown in FIG. 1 and FIG. 3, three cleaning brushes 41, 42, 43 provided on a cleaning machine main body 40 to rotate and revolve, thereby cleaning a polishing powder adhered to the end-face of the ferrule W and the jig plate 14. This cleaning machine main body 44 has a rotating member 45 rotatably supported at a lower portion therewithin. This rotating member 45 is firmly connected with a driving shaft 47 of a driving motor 46 as a rotating member driving means, thereby capable of being driven. The cleaning machine main body 44 is fixed with an annular internal tooth gear 49 at a location below a flange portion 48. On the other hand, the rotating member 45 is pivoted with a first external tooth gear 50 meshing with this internal tooth gear 48, a second external tooth gear 51 meshing with the first external tooth gear 50, and a third external tooth gear 52 meshing with the internal tooth gear 48. These external tooth gears 50, 51, 52 are arranged almost on one straight line along a diameter of the rotating member 45 and they are unbalancedly arranged without an equal interval along one straight line direction, and respectively fixed at their top surfaces with the cleaning brushes 41, 42, 43.

Consequently, by driving the driving motor 46, the respective cleaning brushes 41, 42, 43 revolve while rotating, to perform cleaning of the end-face of the ferrule W and the jig plate 14.

Here, explanations will be made on polishing and cleaning operations for ferrule's end using the end-face polishing and cleaning apparatus of the present invention, which is constituted in the above manner.

In the end-face polishing and cleaning apparatus 10 of the present invention, operations are all performed on the operating panel 19 except for loading and unloading a rod-shaped member, such as ferrule W, on and from the jig plate 14. Consequently, if an operator attaches the ferrule and jig plate 14 and performs input to the operating panel 19, the elevation shaft 17 is first moved to a center axis of the polishing plate 20 on the polishing machine 12, and then the holding member 18 is lowered to a predetermined position. This predetermined position is a position at which the end-face of the ferrule contacts with a polishing sheet placed on the polishing plate under a predetermined load. Thereafter, the polishing machine is operated to rotate the polishing plate 20 in the above-stated manner, thereby polishing the ferrule's end-face to a predetermined shape. When the polishing has finished, the jig plate 14 is moved to above the cleaning machine 13. That is, the holding member 18 is elevated to a predetermined position and the elevation shaft 17 is moved along the support arm 16 to above the cleaning machine 13. Thereafter, the support member 18 is again lowered to a predetermined position. This predetermined position is a position at which the ferrule's end-face contacts with the cleaning brush of the cleaning machine 13 under a predetermined load. When the ferrule is positioned in a predetermined position, the cleaning machine 13 is operated to clean the ferrule's end-face and the jig plate as stated above, thereby completing a series of operations.

In this manner, polishing and cleaning operations can be continuously made only by moving the jig plate 14 in an inverse U-character form. Incidentally, where several stages of polishing operations are required, the polishing sheet is changed and the same operations are repeated by the required number of times.

Next, explanations will be made on an end-face polishing and cleaning apparatus according to another embodiment of the present invention.

The end-face polishing and cleaning apparatus 10A of the present embodiment shown in FIG. 4 is adapted to carry out polishing or cleaning in several stages.

As shown in FIG. 4, the apparatus main body 10A has plural sets, three sets in the present embodiment, of polishing machines 12 and cleaning machines 13 arranged at a predetermined interval A. Further, a support arm 16A is formed extending all over the polishing machines 12 and the cleaning machines 13, and elevation shafts 17A are movably held on all of the polishing machines 12 and the cleaning machines 13. Further, the elevation shafts 17A are formed in nearly inverse U-shape of a predetermined length, i.e., a width of distance A between adjacent polishing machines 12, thereby holding two holding members 18 so as to be vertically movable. That is, two jig plates 14 are held at a predetermined spacing A so as to be horizontally movable along the support arm 16A. Incidentally, other structures are the same as those of the above-stated embodiment.

In the end-face polishing and cleaning apparatus 10A of the present embodiment like this, since the spacing between adjacent polishing machines 12 or cleaning machines 13 is formed so as to be the same as the width between the elevation shafts 17A, two jig plates 14 held through the holding members 18 can be simultaneously positioned on adjacent polishing machines 12 or cleaning machines 13.

According to the above end-face polishing and cleaning apparatus, stepwise polishing and cleaning can be simultaneously and automatically performed at two places only by moving the holding members 18 in a vertical direction while moving the elevation shafts 17A in a horizontal direction, so that a working efficiency can be improved and it becomes possible to shorten the polishing and cleaning operations.

As mentioned above, in the present embodiment, although the two jig plates are simultaneously moved, it is not limited to this and three or more jig plates may be simultaneously moved. Further, in the present embodiment, at least two jig plates are held at an interval of adjacent polishing machines, but, for example, at least two jig plates may be held at an interval of between a polishing machine and an adjacent cleaning machine to perform polishing and cleaning simultaneously and alternately. Further, the polishing machine and the cleaning machine used in the end-face polishing and cleaning apparatus of the present invention are not limited to the above ones. It is understood that it is possible to appropriately use those so long as they can polish or clean a ferrule fixed to the polishing plate only by mounting it from the above.

As explained in detail in the above embodiments, according to the end-face polishing and cleaning apparatus of the present invention, the end-faces of ferrule can be automatically polished and cleaned. Accordingly, a working efficiency can be improved and a cost can be reduced. Further, conditions can be kept constant for a series of operations, thereby stabilizing product quality. Accordingly, mass production becomes possible as well.

What is claimed is:

1. An end-face polishing and cleaning apparatus comprising: at least one pair of jig plates for supporting a plurality of ferrules each fixed to an end of a respective optical fiber; a plurality of sets of polishing and cleaning machines arranged at predetermined intervals, each set of polishing and cleaning machines comprising a polishing machine for polishing end-faces of the optical fibers and ferrules while the optical fibers and ferrules are supported by the jig plates and a cleaning machine for cleaning the end-faces of the ferrules polished by the polishing machine, each of the cleaning machines having a cleaning brush mounted for rotational movement to clean the end-faces of the ferrules and a portion of a lower surface of the jig plates while the cleaning brush is in contact with the lower surface of the jig plates; and movable mounting means for supporting the jig plates and for moving the jig plates between the polishing machines and the cleaning machines to polish and clean the end-faces of the ferrules, the movable mounting means having holding means for supporting the jig plates for undergoing revolving and rotating movement during polishing by the polishing machines, elevation means for moving the holding means in a vertical direction, and horizontal moving means for moving the holding means in a horizontal direction, the jig plates being supported by the holding means for simultaneous movement by the elevation means and the horizontal moving means.

2. An end-face polishing and cleaning apparatus comprising: at least one pair of jig plates for supporting a plurality of ferrules each fixed to an end of a respective optical fiber; a plurality of sets of polishing and cleaning machines arranged at predetermined intervals, each set of polishing and cleaning machines comprising a polishing machine for polishing end-faces of the optical fibers and ferrules while the optical fibers and ferrules are supported by the jig plate and a cleaning machine for cleaning the end-faces of the ferrules polished by the polishing machine, each of the cleaning machines having a cleaning brush mounted for rotational movement to clean the end-faces of the ferrules and a portion of a lower surface of the jig plates while the cleaning brush is in contact with the lower surface of the jig plates; and movable mounting means for supporting the jig plate and for moving the jig plate between the polishing machine and the cleaning machine to polish and clean the end-faces of the ferrules, the movable mounting means having holding means for supporting the jig plate, elevation means for moving the holding means in a vertical direction, and horizontal moving means for moving the holding means in a horizontal direction, the jig plates being supported by the holding means for simultaneous movement by the elevation means and the horizontal moving means.

3. An end-face polishing and cleaning apparatus comprising: at least one jig plate for supporting a plurality of ferrules each fixed to an end of a respective optical fiber; at least one set of polishing and cleaning machines comprising a polishing machine for polishing end-faces of the optical fibers and ferrules while the optical fibers and ferrules are supported by the jig plate and a cleaning machine for cleaning the end-faces of the ferrules polished by the polishing machine, the cleaning machine having a cleaning brush mounted for rotational movement to clean the end-faces of the ferrules and a portion of a lower surface of the jig plate while the cleaning brush is in contact with the lower surface of the jig plate; and movable mounting means for supporting the jig plate and for moving the jig plate between the polishing machine and the cleaning machine to polish and clean the end-faces of the ferrules, the movable mounting means having holding means for supporting the jig plate for undergoing revolving and rotating movement during polishing by the polishing machine, elevation means for moving the holding means in a vertical direction, and horizontal moving means for moving the holding means in a horizontal direction.

4. An end-face polishing and cleaning apparatus comprising: at least one jig plate for supporting a plurality of ferrules each fixed to an end of a respective optical fiber; at least one set of polishing and cleaning machines comprising a polishing machine for polishing end-faces of the optical fibers and ferrules while the optical fibers and ferrules are supported by the jig plate and a cleaning machine for cleaning the end-faces of the ferrules polished by the polishing machine, the cleaning machine having a cleaning brush mounted for rotational movement to clean the end-faces of the ferrules and a portion of a lower surface of the jig plate while the cleaning brush is in contact with the lower surface of the jig plate; and movable mounting means for supporting the jig plate and for moving the jig plate between the polishing machine and the cleaning machine to polish and clean the end-faces of the ferrules, the movable mounting means having holding means for supporting the jig plate, elevation means for moving the holding means in a vertical direction, and horizontal moving means for moving the holding means in a horizontal direction.

5. An end-face polishing and cleaning apparatus comprising: at least one jig plate for supporting a plurality of ferrules each fixed to an end of a respective optical fiber; a plurality of polishing machines for polishing end-faces of the optical fibers and ferrules while the optical fibers and ferrules are supported by the jig plate; a cleaning machine for cleaning the end-faces of the ferrules and optical fibers polished by the polishing machines, the cleaning machine having a cleaning brush mounted for rotational movement to clean the end-faces of the ferrules, the end-faces of the optical fibers, and a portion of a lower surface of the jig plate while the cleaning brush is in contact with the lower surface of the jig plate; and movable mounting means for supporting the jig plate and for moving the jig plate between the polishing machines and the cleaning machine to polish and clean the end-faces of the ferrules and optical fibers, the movable mounting means having holding means for supporting the jig plate, elevation means for moving the holding means in a vertical direction, and horizontal moving means for moving the holding means in a horizontal direction.

6. An end-face polishing and cleaning apparatus comprising: at least one jig plate for supporting a plurality of ferrules each fixed to an end of a respective optical fiber; a plurality of polishing machines for polishing end-faces of the optical fibers and ferrules while the optical fibers and ferrules are supported by the jig plate; a cleaning machine for cleaning the end-faces of the ferrules and optical fibers polished by the Polishing machines, the cleaning machine having a cleaning brush mounted for rotational movement to clean the end-faces of the ferrules, the end-faces of the optical fibers, and a portion of a lower surface of the jig plate while the cleaning brush is in contact with the lower surface of the jig plate; and movable mounting means for supporting the jig plate and for moving the jig plate between the polishing machines and the cleaning machine to polish and clean the end-faces of the ferrules and optical fibers.

7. A polishing and cleaning apparatus comprising: at least one jig plate for supporting a plurality of ferrules; at least one polishing machine for polishing a surface of the ferrules supported by the jig plate; at least one cleaning machine for cleaning the surface of the ferrules polished by the polishing machine, the cleaning machine having a cleaning brush mounted for rotational movement to clean the surface of the ferrules and a portion of a lower surface of the jig plate while the cleaning brush is in contact with the lower surface of the jig plate; and moving means for moving the jig plate between the polishing machine and the cleaning machine to polish and clean the surface of the ferrules.

8. A polishing and cleaning apparatus according to claim 7; wherein the moving means comprises holding means for supporting the jig plate, vertical moving means for moving the holding means in a vertical direction, and horizontal moving means for moving the holding means in a horizontal direction.

9. A polishing and cleaning apparatus according to claim 8; wherein the at least one polishing machine and the at least one cleaning machine comprise a plurality of polishing and cleaning machines arranged at a predetermined interval in the horizontal direction.

10. A polishing and cleaning apparatus according to claim 9; wherein the at least one jig plate comprises at least one pair of jig plates supported by the holding means for simultaneous movement by the vertical moving means and the horizontal moving means.

11. A polishing and cleaning apparatus according to claim 10; wherein the jig plates are supported by the holding means for undergoing revolving and rotating movement during polishing by the polishing machine.

12. A polishing and cleaning apparatus according to claim 8; wherein the at least one jig plate comprises at least one pair of jig plates supported by the holding means for simultaneous movement by the vertical moving means and the horizontal moving means.

13. A polishing and cleaning apparatus according to claim 12; wherein the jig plates are supported by the holding means for undergoing revolving and rotating movement during polishing by the polishing machine.

14. A polishing and cleaning apparatus according to claim 7; wherein the at least one polishing machine and the at least one cleaning machine comprise a plurality of polishing and cleaning machines arranged at a predetermined interval in the horizontal direction.

15. A polishing and cleaning apparatus comprising: at least one jig plate for supporting a plurality of ferrules; a plurality of polishing machines for polishing a surface of the ferrules supported by the jig plate; a cleaning machine for cleaning the surface of the ferrules polished by the polishing machines, the cleaning machine having a cleaning brush mounted for rotational movement to clean the surface of the ferrules and a portion of a lower surface of the jig plate while the cleaning brush is in contact with the lower surface of the jig plate; and moving means for moving the jig plate between the polishing machines and the cleaning machine to polish and clean the surface of the ferrules.

16. A polishing and cleaning apparatus according to claim 15; wherein the moving means comprises a holding member for supporting the jig plate, an elevation shaft for moving the holding member in a vertical direction, and a horizontal moving device for moving the holding member in a horizontal direction.

17. A polishing and cleaning apparatus according to claim 16; wherein the at least one jig plate comprises at least one pair of jig plates supported by the holding member for simultaneous movement by the elevation shaft and the horizontal moving device.

18. A polishing and cleaning apparatus according to claim 17; wherein the jig plates are supported by the holding member for undergoing revolving and rotating movement during polishing by the polishing machine.

* * * * *